US006443564B1

(12) United States Patent
Keil et al.

(10) Patent No.: US 6,443,564 B1
(45) Date of Patent: Sep. 3, 2002

(54) ASYMMETRIC FLUIDIC TECHNIQUES FOR INK-JET PRINTHEADS

(75) Inventors: Ronald W. Keil; Mark S. Barbour; Joseph M. Driear, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/712,698

(22) Filed: Nov. 13, 2000

(51) Int. Cl.[7] ..... B41J 2/05; B41J 2/14; B41J 2/16; B41J 2/17

(52) U.S. Cl. ..... 347/65; 347/47; 347/94

(58) Field of Search ..... 347/65, 94, 44, 347/47, 54, 163

(56) References Cited

U.S. PATENT DOCUMENTS

| | | | | |
|---|---|---|---|---|
| 4,794,411 A | * | 12/1988 | Taub et al. | 347/47 |
| 5,600,349 A | * | 2/1997 | Keefe | 347/65 |
| 5,912,685 A | * | 6/1999 | Raman | 347/65 |
| 6,290,331 B1 | | 9/2001 | Agarwal et al. | 347/47 |

FOREIGN PATENT DOCUMENTS

| | | | |
|---|---|---|---|
| EP | 0787588 B1 | 10/2000 | B41J/2/04 |
| WO | WO01/17782 | 3/2001 | B41J/2/14 |

* cited by examiner

*Primary Examiner*—John Barlow
*Assistant Examiner*—Juanita Stephens

(57) ABSTRACT

A printhead apparatus and method has a plurality of ink drop generators coupled to a source of ink. Each ink drop generator includes an orifice with a corresponding ink firing chamber and a heating resistor, and a single ink feed channel coupling the firing chamber to the source of ink. The geometry of the ink drop generator relative to the heating resistor is selected to introduce an asymmetry to create a rotational component in the ink fluid velocity following a drop ejection. This swirl, in turn changes the location or intensity of the steam bubble, lessening the damage this collapse causes on the resistor, and thereby increasing the resistor life for the printhead. The asymmetry can be the shifting of a pinch point in the ink flow channel relative to the centerline of the channel, by offsetting of the ink flow channel, or by introducing the asymmetry by the relative location of the orifice or firing chamber relative to the firing resistor.

15 Claims, 2 Drawing Sheets

FIG. 1
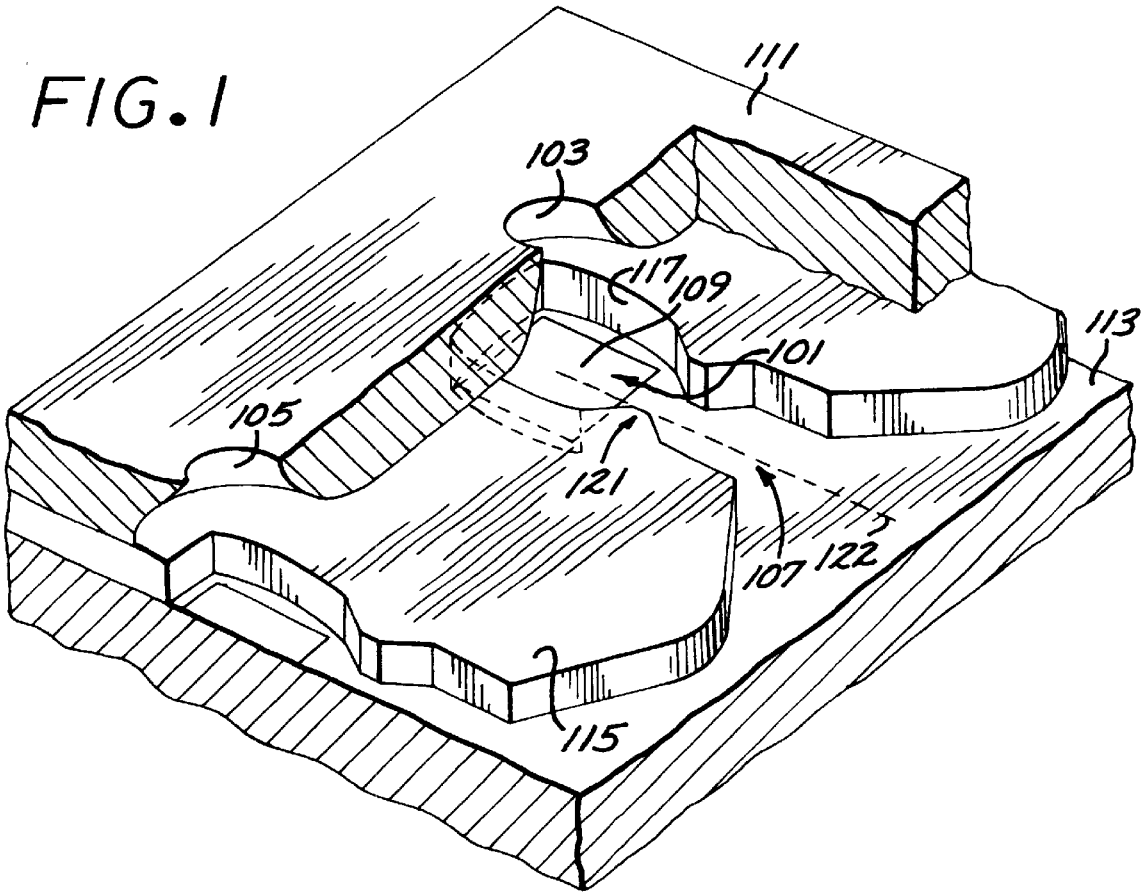
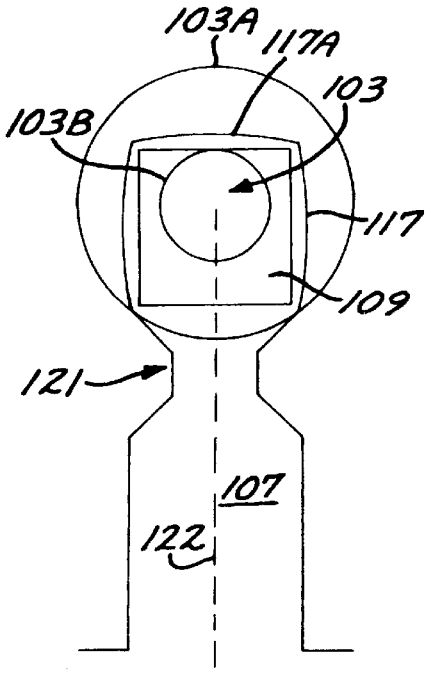
FIG. 2
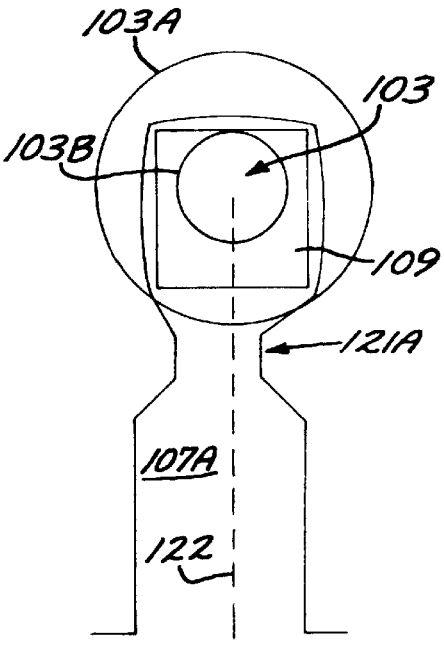
FIG. 3

ASYMMETRIC FLUIDIC TECHNIQUES FOR INK-JET PRINTHEADS

TECHNICAL FIELD OF THE INVENTION

This invention relates to ink-jet printheads, and more particularly to asymmetric fluidic techniques for the printheads.

BACKGROUND OF THE INVENTION

The present invention is generally related to a printhead for an inkjet printer and more particularly related to the design of ink feed channels and ink firing chambers within the printhead.

Thermal inkjet printers operate by expelling a small volume of ink through a plurality of small nozzles or orifices in a surface held in proximity to a medium upon which marks or printing is to be placed. These nozzles are arranged in a fashion in the surface such that the expulsion of a droplet of ink from a determined number of nozzles relative to a particular position of the medium results in the production of a portion of a desired character or image. Controlled repositioning of the substrate or the medium and another expulsion of ink droplets continues the production of more pixels of the desired character or image. Inks of selected colors may be coupled to individual arrangements of nozzles so that selected firing of the orifices can produce a multicolored image by the inkjet printer.

Speed of printing (droplet ejection rate) and quality of print are essential to the user of an inkjet printer. Other factors such as spurious ink spray reduction and accurate positioning of the drop on the medium are also important.

Expulsion of the ink droplet in a conventional thermal inkjet printer is a result of rapid thermal heating of the ink to a temperature which exceeds the boiling point of the ink solvent and creates a vapor phase bubble of ink. Rapid heating of the ink can be achieved by passing a square pulse of electric current through a resistor, typically for 0.5 to 5 microseconds. Each nozzle is coupled to a small unique ink firing chamber filled with ink and having the individually addressable heating element resistor thermally coupled to the ink. As the bubble nucleates and expands, it displaces a volume of ink which is forced out of the nozzle and deposited on the medium. The bubble then collapses and the displaced volume of ink is replenished from a larger ink reservoir by way of ink feed channels.

After the deactivation of the heater resistor and the expulsion of ink from the firing chamber, ink flows back into the firing chamber to fill the volume vacated by the ink which was expelled. It is desirable to have the ink refill the chamber as quickly as possible, thereby enabling very rapid firing of the nozzles of the printhead.

The ink flow into the chamber is through an entrance channel. In some printheads, the entrance channel is narrowed at a pinch point, to control the flow rate, e.g. in cases where different ink channels have different lengths from the ink source. It is desirable in a typical printhead to provide relatively equal flow rates to all the firing chambers of the printhead, to provide good print quality. The pinch points are employed to aid in this goal.

Prolongation of printhead life is one goal of printhead designers. One failure mode for printheads, which leads to shortened life, is failure of the resistors due to damage resulting from firing the resistor. This problem is exacerbated when the printhead is designed to produce droplets of relatively high drop weight, typically 8 nanograms or larger, and relatively high firing rates, typically 12 Khz or greater.

One technique which has been employed with inkjet printheads to seek to reduce resistor damage is to move the nozzle bore, along a center line through the resistor and ink feed channel, toward the firing chamber back wall, to move the bubble collapse off the resistor into the ink feed channel.

SUMMARY OF THE INVENTION

A printhead apparatus and method has a plurality of ink drop generators coupled to a source of ink. Each ink drop generator includes an orifice with a corresponding ink firing chamber and a heating resistor, and an ink feed channel coupling the firing chamber to the source of ink. The geometry of the ink drop generator relative to the heating resistor is selected to introduce an asymmetry to create a rotational component to the ink fluid velocity during bubble collapse. This rotational component, in turn changes the location or intensity of the steam bubble, lessening the damage this collapse causes on the resistor, and thereby increasing the resistor life for the printhead.

BRIEF DESCRIPTION OF THE DRAWINGS

These and other features and advantages of the present invention will become more apparent from the following detailed description of an exemplary embodiment thereof, as illustrated in the accompanying drawings, in which:

FIG. 1 is an isometric view of an inkjet printer printhead.

FIG. 2 is a schematic enlarged top view illustrating a symmetrical geometry of the ink flow channel of a printhead, with a nozzle offset toward the back of a chamber.

FIG. 3 is a schematic enlarged top view of a portion of an inkjet printhead, illustrating an asymmetry in the geometry of the ink flow channel in accordance with an aspect of the invention.

DETAILED DESCRIPTION OF THE PREFERRED EMBODIMENTS

Figure 4:
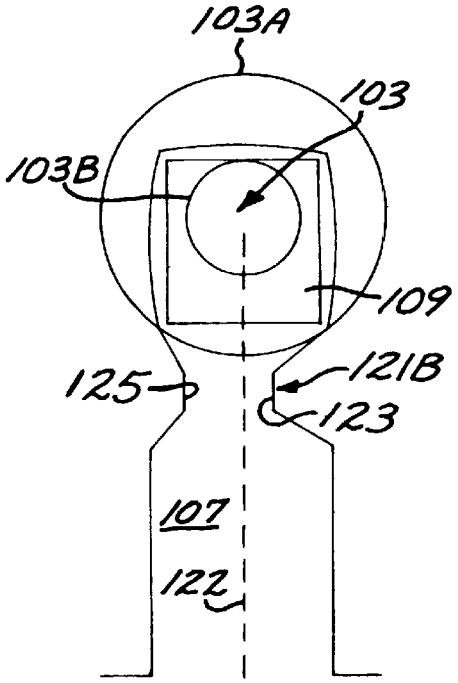
FIG. 4 is a schematic enlarged top view, illustrating an alternate embodiment of an ink drop generator geometry in accordance with an aspect of the invention.

A greatly magnified isometric view of a portion of a typical thermal inkjet printhead for use in an inkjet printer is shown in FIG. 1. The printhead includes many ink drop generators, each including an ink firing chamber, an orifice through which the ink drop is expelled, and a firing resistor. In FIG. 1, several elements of the printhead have been sectioned to reveal an ink firing chamber 101 within the inkjet printhead. Many such firing chambers are typically arranged in a staggered row in the printhead and two or more such rows can be arranged in a group around an ink supply plenum for efficient and high quality printing. Additional groups may be located in the printhead to allow for individual colors to be printed from each group.

Associated with each firing chamber 101 is a nozzle 103 disposed relative to the firing chamber 101 so that ink which is rapidly heated in the firing chamber by a heater resistor 109 is forcibly expelled as a droplet from the nozzle 103. Part of a second nozzle 105, associated with another ink firing chamber, is also shown.

The heater resistors are selected by a microprocessor and associated circuitry in the printer in a pattern related to the data entered into the printer so that ink which is expelled from selected nozzles creates a defined character or figure of print on the medium. The medium (not shown) is typically held parallel to the orifice plate 111 and perpendicular to the direction of the ink droplet expelled from the nozzle 103.

Ink is supplied to the firing chamber 101 via an opening 107 commonly called an ink feed channel. This ink is supplied to the ink feed channel 107 from a much larger ink reservoir (not shown) by way of an ink plenum formed by the space between the orifice plate and the substrate, external to the firing chambers, and common to all firing chambers in a group.

Once the ink is in the firing chamber 101, it remains there until it is rapidly heated to boiling by the heater resistor 109. Conventionally, the heater resistor 109 is a thin film resistance structure disposed on the surface of a silicon substrate 113 and connected to electronic circuitry of the printer by way of conductors disposed on the substrate 113. Printheads having increased complexity typically have some portion of the electronic circuitry constructed in integrated circuit form on the silicon substrate 113. Various layers of protection such as passivation layers and cavitation barrier layers may further cover the heater resistor 109 to protect it from corrosive and abrasive characteristics of the ink. Thus, in this exemplary embodiment, the ink firing chamber 101 is bounded on one side by the silicon substrate 113 with its heater resistor 109 and other layers, and bounded on the other side by the orifice plate 111 with its attendant orifice 103. The other sides of the firing chamber 101, indicated generally as side 117 in FIG. 1, and the ink feed channel 107 are defined by a polymer barrier layer 115. This barrier layer is preferably made of an organic polymer plastic which is substantially inert to the corrosive action of ink and is conventionally deposited upon substrate 113 and its various protective layers and is subsequently photolithographically defined into desired geometric shapes and etched. Polymers suitable for the purpose of forming a barrier layer 115 include products sold under the names Parad, Vacrel, and Riston by E. I. DuPont De Nemours and Company of Wilmington, Del. Such materials can withstand temperatures as high as 300 degrees C. and have good adhesive properties for holding the orifice plate of the printhead in position.

In the exemplary printhead of FIG. 1, the orifice plate 111 is secured to the silicon substrate 113 by the barrier layer 1 15. Typically the orifice plate 111 can be constructed of nickel, or similar material, with a plating of gold to resist the corrosive effects of the ink, or fabricated of Kapton (™) using laser ablation to define the nozzle orifices. In order to damp the flow of ink from the ink source, the ink feed channel 107 at the entrance to the chamber is constricted at pinch point 121 to form an entrance channel of decreasing channel width. The pinch point is a constriction at the entrance of the resistor firing chamber, between the resistor and the channel.

This invention is useful in reducing damage to resistors caused by the expulsion of ink droplets during printing. This is a more significant problem for high-drop-weight printheads relative to the resistor layer thickness, e.g., in this exemplary embodiment for a tantalum resistor layer thickness of 6000 Angstroms, printheads which are designed to produce droplets of at least 8 nanograms (ng). Of course, if the tantalum layer thickness is reduced, the drop weight considered to be high would also be reduced.

Techniques for providing a printhead for producing high drop weights are well known in the art, and include larger orifice sizing, and scaling of elements of the ink drop generator to produce the larger droplets. The printhead illustrated in FIG. 1 is adapted for producing droplets of high drop weight, and at a relatively high firing frequency, in this example 36 Khz. For this exemplary embodiment, the orifice 103 has a nominal entrance bore diameter of 52 microns and a nominal exit bore diameter of about 22 microns. The resistor has a nominal size of 28 microns by 28 microns. The firing chamber has a nominal size of about 32 microns by 32 microns at the widest points.

In the past, and with the exception of multiple-channel designs, the entrance channels have typically been designed to be symmetric about the centerline 122 of the entrance channel. FIG. 2 is a schematic top view of a printhead having a symmetrical ink feed arrangement, wherein the entrance channel 107 and the pinch point 121 are symmetrical with respect to the channel axis or center line 122 which passes through the center of the resistor. The channel 107 leads to the firing chamber with resistor 109, with the orifice 103 disposed above the resistor 109. The orifice 103 in this embodiment is characterized by an entrance bore 103A and an exit bore 103B, with ink forced from the chamber into the orifice entrance bore and through the exit bore in response to the firing of the resistor 109. The orifice 103 illustrated in FIG. 1 has a 4 micron offset toward the back wall 117A (defined by the barrier layer 115) of the chamber. Even with this offset of the bore toward the back wall, the ink drop generator is symmetrical with respect to the center line 122, which passes through the center of the resistor 109 and through the ink channel 107.

In response to a current drive pulse to the heater resistor 109, a drive bubble is created in the ink in the chamber and expands. During bubble expansion, ink is pushed past the pinch point of the chamber and into the ink feed channel, as well as vertically into the nozzle orifice 103. Once the bubble has expended its energy, it begins to collapse. There are two components to bubble collapse. The first is the bubble collapse from the ink feed channel past the pinch point and into the chamber, resulting in ink flow into the chamber from the ink feed channel. This is the "refill" ink. The second component of the bubble collapse is produced by the contracting gas bubble from the orifice back into the firing chamber. These two components of bubble collapse interact in the firing chamber 101 to create a localized high pressure event on the resistor surface, which damages the top coating (typically tantalum) on the resistor as well as the underlying resistor material (typically TaAl), reducing resistor life.

The use of a pinch point in the ink feed channel at the entrance to the firing chamber is important in providing a high drop weight generator, since the pinch point tends to contain the bubble energy from dissipating toward the ink channel, so that more of the bubble energy is directed toward the nozzle orifice. This increases the efficiency of the ink drop generator, particularly at high firing rates. The use of a pinch point adjacent the firing chamber can exacerbate the damage to the resistor caused by bubble collapse, since the bubble is constrained by the pinch point from movement off the resistor toward the feed channel.

In accordance with an aspect of the invention, an asymmetry is introduced in the geometry of one or more elements of the ink drop generator relative to the nominal center line 122 (FIG. 2) to create a rotational component to the ink fluid velocity during bubble collapse. This additional rotational component reduces the magnitude of the damage to the Ta top coat and TaAl resistor, thereby improving resistor life. Several techniques are now described for introducing this additional rotational component to the fluid velocity during bubble collapse.

The asymmetry can be introduced to produce a swirl in the ink flowing into the chamber during refill following a drop ejection, i.e. affecting the first component of ink in the chamber described above. This swirl, in turn, changes the location or intensity of collapse of the steam bubble, lessening the damage this collapse causes on the resistor. FIG. 3 illustrates an exemplary embodiment, wherein the asymmetry is a modification of the entrance channel and the pinch point, so that the entrance channel 107A and pinch point 121A are slightly off center from the nominal center axis 122 which passes through the center of the resistor 109. The figures are not drawn to scale, and the offset is exaggerated to better illustrate the concept. In an exemplary embodiment, the entrance channel has a nominal width of 60 microns, and the channel width at the pinch point ranges from 20 microns to 28 microns, depending on the location of the firing chamber in the printhead; a typical dimension is 25 microns. By shifting the location of the entrance channel and the pinch point to be at least 2–10 microns offset from the center of the nominal axis 122, a swirl is introduced to change the location or intensity of collapse of the steam bubble. The greater the offset, the more significant is the reduction in resistor damage.

The particular dimensions for the channel width and the offset can be varied depending on the particular application. By offsetting the ink flow path relative to the heater resistor, a swirl is introduced in the ink flowing into the chamber, thus leading to reduction in damage to the resistor due to the collapse of the steam bubble.

FIG. 4 is a schematic enlarged top view, illustrating an alternate embodiment of an ink drop generator geometry in accordance with an aspect of the invention. In this embodiment, the channel 107 is symmetrical with the nominal center line 122, i.e. in the same location as illustrated in FIG. 1. However, the pinch point 121B is offset relative to the center line 122, so that constriction point 123 on one side of the pinch point is closer to the center line 122 than the constriction point 125 at the opposite side. In an exemplary embodiment, with the entrance channel having a nominal width of 60 microns, and the channel width at the pinch point of 25 microns, the offset of the pinch point relative to the center line is in the range of 2 microns to 10 microns. This alternate geometry also produces a swirl in the ink entering the firing chamber, which reduces damage to the resistor in a manner similar to the embodiment of FIG. 3.

Figure 5:
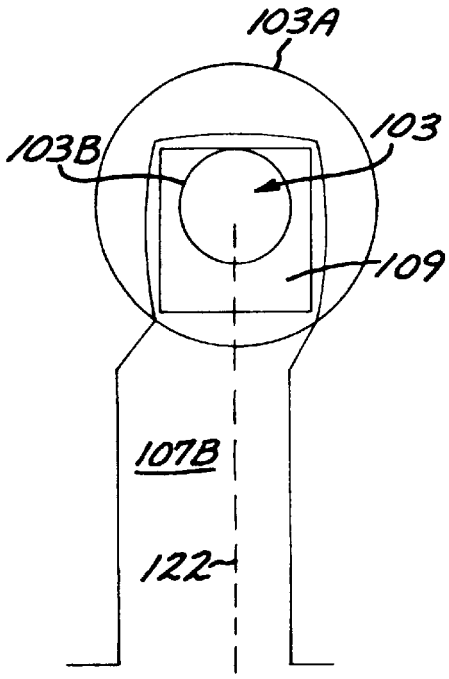
FIG. 5 is a schematic enlarged top view of a portion of a printhead, illustrates a further embodiment of a printhead geometry employing an aspect of this invention.

FIG. 5 illustrates a further embodiment of a printhead geometry employing an aspect of this invention. The ink flow channel 107B of this embodiment does not include a pinch point at the entrance to the firing chamber. To create a swirl in the ink flowing into the chamber to refill after a drop has been ejected, the ink flow channel 107B is offset from the nominal center line 122 passing through the center of the resistor pad. For an exemplary embodiment having a nominal ink flow channel width of 60 microns, the magnitude of the offset from the center line 122 is in the range of 5 microns to 15 microns.

The embodiments illustrated in FIGS. 3–5 have introduced asymmetries in the ink feed path into the chamber from the ink source, thus affecting the refill component of ink described above. Other techniques for introducing a rotational component to the fluid flow during bubble collapse affect the second component of ink, i.e. ink already in the chamber, which flows vertically into the chamber from the nozzle orifice. In accordance with this technique, an asymmetry is introduced in the nozzle bore with respect to its position relative to the nominal center line 122, or both the nozzle bore and barrier position.

Figure 6:
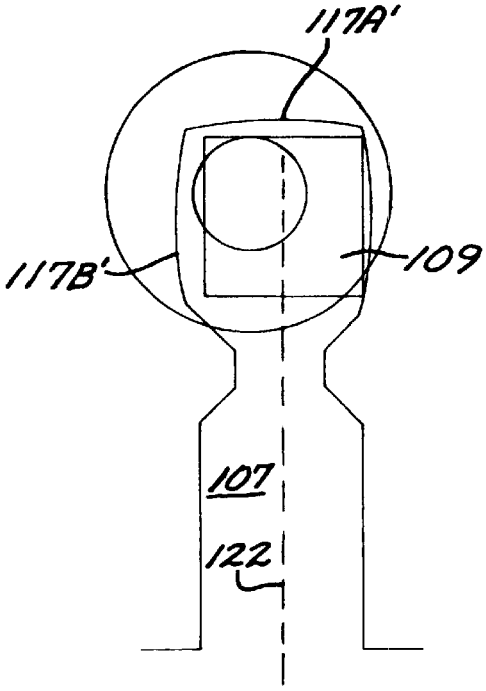
FIG. 6 is a schematic enlarged top view of a portion of a printhead, illustrates another technique for creating an additional rotational component in the ink fluid velocity during bubble collapse.

FIG. 6 illustrates this technique for creating a swirl in the ink refilling the chamber. For this embodiment, the ink flow channel 107 and the pinch point 121 are symmetrical with the respect to the center line 122 passing through the center of the resistor 109. However, the location of the orifice 103 is moved diagonally relative to the center line 122 toward the side wall 117B of the firing chamber. In an exemplary embodiment, with the entrance bore dimension of 52 microns, the exit bore dimension of 22–23 microns, and the resistor size of 28 microns by 28 microns, the orifice is moved diagonally relative to the center line 122 by relocating the orifice in the orifice plate 6 microns toward the side wall 117B' relative to the center of the resistor 109, and 4 microns toward the back wall 117A', relative to the center of the resistor 109. This geometry provides a substantial increase in resistor life over the symmetrical geometry illustrated in FIG. 2.

The movement in the barrier layer 115 when combined with the diagonal movement of the orifice relative to the center of the resistor provides a further increase in the resistor life. In this exemplary embodiment, the barrier layer 115 defining the chamber can be offset slightly relative to the center of the resistor, so that the chamber walls are slightly offset relative to the resistor, in this example by a 2 micron movement of side wall 117B' and a 2 micron movement of back wall 117A' away from the center of the resistor 109. Of course, while this position of the barrier is described with respect to a "movement" of the barrier, the effect can be achieved by redesigning the barrier so that the relative locations of the openings defining the chamber walls are shifted, or by shifting the resistor position within the chamber.

The asymmetry illustrated in FIG. 6 can be combined in other embodiments with asymmetries regarding the ink refill component, illustrated in FIGS. 3–5.

Figure 7:
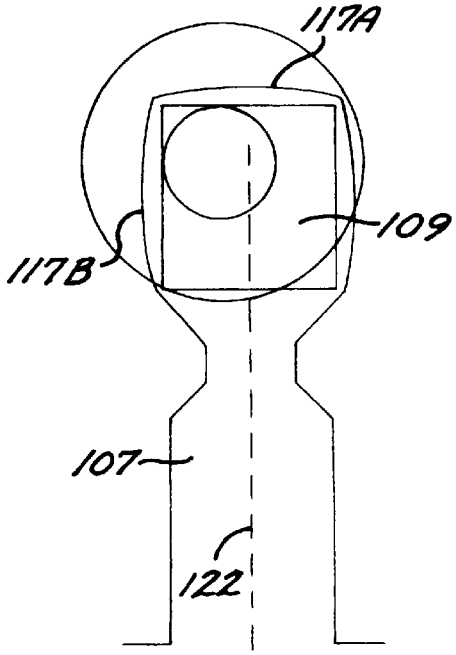
FIG. 7 illustrates an asymmetric geometry wherein only the orifice location relative to the resistor is shifted, and where the barrier layer is in the same symmetrical location as illustrated in FIG. 2.

FIG. 7 illustrates an asymmetric geometry wherein only the orifice location relative to the resistor is shifted, and where the barrier layer is in the same symmetrical location as illustrated in FIG. 2. Thus, for this embodiment, the orifice location relative to the center of the resistor is moved 6 microns toward the side wall 117B. The entrance channel and pinch point is symmetrical with respect to the center line 122 for the embodiment of FIG. 7.

The diagonal offset of the nozzle orifice relative to the center line 122 and the center of the resistor 109 has been found to substantially improve the resistor life. Moreover, this diagonal offset has also been found to reduce "droop slope" of the printhead, i.e. the loss of ejected drop weight with increasing frequency in the steady-state operating range of the printhead. The diagonal offset of the orifice position is believed to create an interaction between the bubble collapse from the nozzle orifice and the ink refilling from the ink channel. This interaction reduces the effect of bubble collapse damage while creating a rotational flow in the firing chamber believed to help remove residual trapped air from the chamber.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printhead apparatus comprising a plurality of ink drop generators coupled to a source of ink, each ink drop generator including a nozzle orifices with a corresponding ink firing chamber and a heating resistor, and a single ink flow channel coupling the firing chamber to the source of ink, wherein selective energization of the heating resistor during printing operation creates a bubble causing ink drop ejection through the orifice, with the bubble subsequently collapsing, and wherein the geometry of the ink flow channel or the nozzle orifice, or of both the ink flow channel and the nozzle orifice, is asymmetric with respect to the heating resistor to produce a rotational component to an ink fluid velocity during bubble collapse, resulting in reduction in damage to the resistor caused by the bubble collapse, wherein the asymmetric geometry is an asymmetry in the single ink flow channel relative to the heating resistor to create a swirl in the ink flowing into the chamber during refill following a drop ejection.

2. The apparatus of claim 1, wherein the chamber has a center axis, and the single ink flow channel narrows down to a pinch area at an entrance to the firing chamber, and wherein the asymmetry includes an offset of the ink flow channel relative to the center axis.

3. The apparatus of claim 2, wherein the asymmetry further includes an offset in the pinch area relative to the center axis.

4. The apparatus of claim 1, wherein the chamber has a center axis, and the single ink flow channel narrows down to a pinch point at an entrance to the firing chamber, and wherein the asymmetry includes an offset of the pinch area in the ink flow channel relative to the center axis.

5. The apparatus of claim 1, wherein the chamber has a center axis, and wherein the asymmetry includes an offset of the single ink flow channel relative to the center axis.

6. The apparatus of claim 1, wherein the ink drop generator is adapted to produce ink drops of nominal drop weight greater than 8 nanograms.

7. A printhead apparatus comprising a plurality of ink drop generators coupled to a source of ink, each ink drop generator including a nozzle orifice with a corresponding ink firing chamber and a heating resistor, and a single ink flow channel coupling the firing chamber to the source of ink, wherein selective energization of the heating resistor during printing operation creates a bubble causing ink drop ejection through the orifice, with the bubble subsequently collapsing, and wherein the geometry of the ink flow channel or the nozzle orifice, or of both the ink flow channel and the nozzle orifice, is asymmetric with respect to the heating resistor to produce a rotational component to an ink fluid velocity during bubble collapse, resulting in reduction in damage to the resistor caused by the bubble collapse, wherein the asymmetric geometry includes a diagonal offset in a position of the nozzle orifice relative to the heating resistor, to thereby create a rotational component to ink in the nozzle flowing into the chamber upon bubble collapse, and wherein the nozzle orifice is offset toward a sidewall of the chamber away from the center of the heating resistor and toward a back wall of the chamber away from the single ink flow channel.

8. A method of reducing damage to a plurality of heating resistors in an inkjet printer printhead having a source of ink, a plurality of ink firing chambers each with a single ink flow channel coupling the chamber to a source of ink, and a plurality of orifices, comprising:

filling the ink chambers with ink through a corresponding one of the ink flow channels;

selectively firing the heating resistors to create a steam bubble in the firing chambers and selectively cause drop ejection of ink drops from the chambers through the orifices, the bubble subsequently collapsing; and producing a rotational component to an ink fluid velocity during said bubble collapse and refilling of the chamber to reduce damage to the resistors caused by said bubble collapse; and wherein said filling step produces a swirl in the ink flow into the respective chambers, to thereby change the location or intensity of a collapse in the steam bubble, said filling step including passing ink through a single of offset flow channel relative to the heating resistor to create said swirl.

9. A method of reducing damage to a plurality of heating resistors in an inkjet printer printhead having a source of ink, a plurality of ink firing chambers each with a single ink flow channel coupling the chamber to a source of ink, and a plurality of orifices, comprising:

filling the ink chambers with ink through a corresponding one of the ink flow channels;

selectively firing the heating resistors to create a steam bubble in the firing chambers and selectively cause drop ejection of ink drops from the chambers through the orifices, the bubble subsequently collapsing; and producing a rotational component to an ink fluid velocity during said bubble collapse and refilling of the chamber to reduce damage to the resistors caused by said bubble collapse; and wherein the single ink flow channels include respective offset pinch areas adjacent the respective chambers.

10. The method of claim 9, wherein each of the single ink flow channels is offset relative to the respective resistors.

11. A method of reducing damage to a plurality of heating resistors in an inkjet printer printhead having a source of ink, a plurality of ink firing chambers each with a single ink flow channel coupling the chamber to a source of ink, and a plurality of orifices, comprising:

filling the ink chambers with ink through a corresponding one of the ink flow channels;

selectively firing the heating resistors to create a steam bubble in the firing chambers and selectively cause drop ejection of ink drops from the chambers through the orifices, the bubble subsequently collapsing; and producing a rotational component to an ink fluid velocity during said bubble collapse and refilling of the chamber to reduce damage to the resistors caused by said bubble collapse; and wherein said filling step produces a swirl in the ink flow into the respective chambers, to thereby change the location or intensity of a collapse in the steam bubble, and wherein each of the single ink flow channels is offset relative to the respective resistors.

12. A method of reducing damage to a plurality of heating resistors in an inkjet printer printhead having a source of ink, a plurality of ink firing chambers each with a single ink flow channel coupling the chamber to a source of ink, and a plurality of orifices, comprising:

filling the ink chambers with ink through a corresponding one of the ink flow channels;

selectively firing the heating resistors to create a steam bubble in the firing chambers and selectively cause drop ejection of ink drops from the chambers through the orifices, the bubble subsequently collapsing; and producing a rotational component to an ink fluid velocity during said bubble collapse and refilling of the chamber to reduce damage to the resistors caused by said bubble collapse; and wherein the nozzle orifice is diagonally offset toward a sidewall of the chamber and toward a back wall of the chamber away from the center of the heating resistor, the offset creating the rotational component as ink flows from the orifice to the chamber upon bubble collapse.

13. The method of claim 12, wherein the nozzle orifice is defined in an orifice plate, and the printhead further includes a substrate on which a thin film structure defining the heating resistor is formed, and a barrier layer disposed between the substrate and the orifice plate, the barrier layer defining sidewalls of the chamber, and a position of the barrier layer with respect to the center of the resistor is offset so that chamber sidewalls are offset relative to said center, said offsetting tending to create the rotational component in ink fluid velocity.

14. A printhead apparatus comprising a plurality of ink drop generators coupled to a source of ink, each ink drop generator including an orifice with a corresponding ink firing chamber and a heating resistor, and a single ink flow channel coupling each firing chamber to the source of ink, the single ink flow channel including a pinch region of reduced width adjacent the firing chamber, and wherein the geometry of the ink flow channel is asymmetric with respect to a location of the heating resistor to create a swirl in the ink flowing into the chamber during refill following a drop ejection.

15. A printhead apparatus comprising a plurality of ink drop generators coupled to a source of ink, each ink drop generator including a nozzle orifice with a corresponding ink firing chamber and a heating resistor, and a single ink flow channel coupling the firing chamber to the source of ink, the nozzle orifice defined in an orifice plate, the heating resistor defined in a thin film structure formed on a substrate, a barrier layer disposed between the substrate and the orifice plate, the barrier layer defining sidewalls of the chamber, wherein selective energization of the heating resistor during printing operation creates a bubble causing ink drop ejection through the orifice, with the bubble subsequently collapsing, and wherein the geometry of the single ink flow channel or the nozzle orifice, or of both the single ink flow channel and the nozzle orifice, is asymmetric with respect to the heating resistor to produce a rotational component to an ink fluid velocity during bubble collapse, resulting in reduction in damage to the resistor caused by the bubble collapse, said asymmetric geometry including a diagonal offset in a position of the nozzle orifice relative to the heating resistor, to thereby create a rotational component to ink in the nozzle flowing into the chamber upon bubble collapse, and wherein the asymmetric geometry includes an offsetting in a position of the barrier layer with respect to the center of the resistor so that chamber sidewalls are offset relative to said center and to said single ink flow channel.

* * * * *